United States Patent [19]

Mohler

[11] Patent Number: 4,472,085

[45] Date of Patent: Sep. 18, 1984

[54] CAISSON CAP

[75] Inventor: Roy J. Mohler, North Canton, Ohio

[73] Assignee: The Union Metal Manufacturing Co., Canton, Ohio

[21] Appl. No.: 497,002

[22] Filed: May 23, 1983

Related U.S. Application Data

[63] Continuation of Ser. No. 330,371, Dec. 14, 1981, abandoned.

[51] Int. Cl.[3] ..... E02D 5/52

[52] U.S. Cl. ..... 405/255; 173/132

[58] Field of Search ..... 405/255, 232, 249, 303; 173/132; 138/89, 96 R, 89.1–89.4, 109; 285/405, 406, 413

[56] References Cited

U.S. PATENT DOCUMENTS

| | | | |
|---|---|---|---|
| 758,102 | 4/1904 | Powers | 285/413 |
| 1,062,438 | 5/1913 | Clark | 285/413 |
| 2,969,995 | 1/1961 | Boughton | 285/413 |
| 3,324,894 | 6/1967 | Deal | 138/109 |
| 3,848,421 | 11/1974 | O'Brien | 285/405 |

FOREIGN PATENT DOCUMENTS

| | | | |
|---|---|---|---|
| 679903 | 8/1939 | Fed. Rep. of Germany | 285/413 |
| 2259688 | 6/1973 | Fed. Rep. of Germany | 138/109 |
| 1349315 | 2/1963 | France | 405/232 |

*Primary Examiner*—Ernest R. Purser
*Assistant Examiner*—Mark J. DelSignore
*Attorney, Agent, or Firm*—Oldham, Oldham, Hudak, Weber & Sand Co.

[57] ABSTRACT

A cap formed of cast steel is permanently attached to the top end of a tubular metal caisson to facilitate the handling of the caisson and its installation with a sonic or vibratory driver/extractor mechanism. The cap has an annular base formed with a relatively large central opening. A plurality of bolt-receiving holes are formed in the base and are spaced in an arrangement for subsequent mounting of a superstructure on the caisson. A pair of diametrically spaced clamping plates is formed integrally with the base for cooperative engagement with the vibratory mechanism. A pair of diametrically spaced lifting lugs are mounted on the base between the clamping plates to facilitate the handling of the cap and caisson. The clamping plates each have a straight chordlike center section and may have a pair of end sections. The cap has a size slightly larger than the size of the caisson top end and is secured thereon by one or more welds.

20 Claims, 11 Drawing Figures

CAISSON CAP

This is a continuation of application Ser. No. 330,371, filed Dec. 14, 1981, now abandoned.

BACKGROUND OF THE INVENTION

1. Field of the Invention

The invention relates to foundations for supporting superstructures and particularly to caissons which are vibrated into the soil for supporting a superstructure on the top end thereof. More particularly, the invention relates to an improved cap adapted to be permanently mounted on the top of the caisson to facilitate the installation of the caisson and to provide an attachment plate for the base of a superstructure to be supported thereon.

2. Description of the Prior Art

There are numerous types, styles and arrangements of foundations which are placed in the soil for supporting a superstructure on the top thereof, whether the superstructure be a building, pole, tower, bridge, etc. These foundations can be metal, concrete or a combination of both. One type of foundation herein referred to as a caisson is a circular or polygon-shaped elongated hollow tubular member with an open bottom, which is vibrated into the soil usually by a sonic or vibratory driver/extractor mechanism.

A sonic or vibratory driver/extractor drives a caisson by being rigidly connected to the caisson, usually by clamps, and by oscillating the caisson into the soil. The vibration "fluidizes" the soil particles in contact with the caisson thereby reducing friction and affecting rapid drive rates. Vibratory driver/extractors incorporate the unique capability of being instantly converted from caisson driver to caisson extractor by merely pulling up on the vibratory crane secondary hoist line.

To install caissons using a sonic or vibratory driver-/extractor, the caisson must be raised into a vertical position and the sonic or vibratory driver/extractor attached to the caisson before driving can begin.

Caissons with open tops can be raised into a vertical position by use of lifting holes in the caisson walls near the top end. After the open top caisson is erect, the sonic or vibratory driver/extractor is attached by means of clamps which firmly grip the caisson wall on opposite sides. Upon completion of driving the sonic or vibratory driver/extractor clamps are released and the driving equipment can proceed to the next operation.

After installation of an open top caisson, the superstructure may be attached by various methods including: (1) field welding; (2) anchor bolts embedded in concrete enclosed by the caisson; (3) the lower part of the superstructure may be telescoped inside or outside the caisson top and held in place by bolts and grout.

There are project locations or conditions where use of the above superstructure attachment methods to an open top caisson are not practical or economically feasible. Field welding is prohibited by many specifications. Transportation and placing of concrete and/or grout may be impractical. To minimize superstructure attachment problems, a closed top or capped caisson may be used.

Closed top caissons capped with an integral plate incorporating means of attaching a superstructure may be raised into a vertical position and driven by use of a portable driving head which is bolted to the integral caisson cap before raising and removed after the driving is completed. The portable driving head incorporates lifting holes to aid in raising the caisson and plates for attachment of the sonic or vibratory driver/extractor clamps. Attachment of the portable driving head to the integral caisson cap must be carefully done since the effectiveness of the sonic or vibratory driver/extractor is dependent on a rigid connection. It is difficult and time-consuming to make a rigid bolted connection since the nuts must be tightened sufficiently to minimize gap between the faying surfaces of the portable driving head and the caisson cap. The fact that plates of the sizes involved may have sizeable permissible variations in flatness adds to the difficulties. Use of the vibratory crane to handle the portable driving head is usually not economical, so an additional piece of equipment may be required to assist in installing and removing portable driving heads.

A portable driving head is not required for installing closed top caissons or caissons capped with an integral plate if a pair of diametrically-spaced rectangularly-shaped plates are welded to the caisson top adjacent to its periphery. These plates provide a place for attachment of the sonic or vibratory driver/extractor clamps. Since the clamping plates transmit the vibratory driving forces into the caisson, their alignment and attachment to the caisson top must be done with care.

After installation of a closed top caisson, the superstructure may be attached by various methods including: (1) field welding; (2) bolting into drilled and tapped holes in the caisson top; (3) bolting through holes in the caisson top that match holes or bolts in the mating surface of the superstructures.

In the past, steel plates has been used as the top or cap for the closed top caissons described above. When considerable forces are involved, structural analysis may require not only an excessively thick top plate, but the opening in the center may become so small that access to the inside of the caisson from the top becomes difficult. Liberal access to the inside of the caisson through the top or cap is desirable for: (1) ease of applying and inspection of any internal weld that may be specified between the bottom surface of the caisson top or cap and the inside wall of the caisson tube; (2) removal of dangerous welding gases and fumes which may be hazardous to the worker's health from the partially closed interior of the caisson during application of any interior weld; (3) ease of insertion of bolts through the caisson top in a predetermined bolt pattern which will be used for attaching a superstructure. The bolts normally would be inserted from the caisson interior with the bolt head bearing against the underside of the caisson top; (4) almost unlimited observation of the interior of the driven caisson before a worker puts his hand inside for any reason. The void left inside the top portion of the caisson after it has been driven has been used in the past as a gathering place for wildlife, including snakes.

Accordingly, the need has existed for an improved caisson cap which eliminates the various problems described above which are present in existing caisson top or caisson cap construction. There is no known caisson cap construction of which I am aware which eliminates these problems by providing a cap formed of cast steel having a relatively large central opening in addition to the unique features and advantages described below.

SUMMARY OF THE INVENTION

Objectives of the invention include providing an improved caisson cap formed of cast steel which has an annular configuration and is provided with a central opening which is relatively large with respect to the width of the cap without sacrificing the required high structural strength needed for the superstructure to be mounted and bolted thereon. Another objective is to provide such a caisson cap in which the sonic or vibratory driver/extractor clamping plates may be formed integrally with the annular base thereby eliminating separate welding operations for attaching such clamping plates to the top of the caisson cap, in which a pair of lifting lugs also can be formed integrally on the cap to provide for easier handling during manufacturing, galvanizing, shipping and during field installation of the caisson, and in which the cap, lifting lugs and clamping plates have contours generally free of sharp corners and pockets which minimizes structurally objectionable stress raisers and provides for a better and more satisfactory galvanized finish than prior cap constructions having sharp corners and edges.

Another objective of the invention is to provide such a caisson cap in which the clamping plates may have curved end sections which extend partially about the perimeter of the cap to distribute more evenly the vibratory loads to the caisson than in prior rectangular clamping plate configurations, in which the curved ends stiffen the clamping plate to resist lateral loads and to reduce breakage. Another objective is to provide such a caisson cap in which better dimensional uniformity is achieved due to the cast forming of the cap, especially in maintaining the distance between the clamping plates and their orientation on the cap base than is possible with prior caps having welded clamping plates.

A still further objective of the invention is to provide such a caisson cap in which the cast forming thereof enables a relatively large central opening to be formed which provides easier access to the interior of the caisson which enables any interior weld between the bottom surface of the cap and the inside wall of the caisson to be performed by workmen situated externally of the cap and in which inspection of the weld is easier, in which the enlarged central opening facilitates initial installation and/or tightening of the anchor bolts should preinstalled bolts become loosened during the driving operation, and in which this enlarged central opening enables workmen to check for snakes and other wildlife which may be located within the void of the upper portion of the caisson before performing work through the central opening due to the greater visibility provided by the enlarged opening.

A further objective of the invention is to provide such an improved caisson cap which enables the size of the caisson to be reduced for certain installations since the unique design and construction of the cap provides high structural strength, thereby reducing caisson weight resulting in easier handling and possible use of smaller installation equipment, which reduces the amount of steel, freight and handling costs, and which reduces the amount of circumferential cap welding without sacrificing the required strength and rigidity as a foundation for a superstructure to be supported thereby. Another objective is to provide such a cap in which reference marks may be accurately formed on the cap during the cast forming thereof to facilitate the alignment of the caisson and cap during fabrication and field installation.

These objectives and advantages are obtained by the improved cap construction of the invention, the general nature of which may be stated as including a cast steel base formed with a central opening, said central opening having an area approximately 50% of the area defined by the periphery of the base; a plurality of spaced bolt-receiving holes formed in the base; clamping plate means mounted on the base for cooperative engagement with a vibratory mechanism for driving the caisson into the soil; and lifting lugs cast on the base for ease of handling during manufacture and field installation.

BRIEF DESCRIPTION OF THE DRAWINGS

A preferred embodiment of the invention, illustrative of the best mode in which applicant has contemplated applying the principles, is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 1:
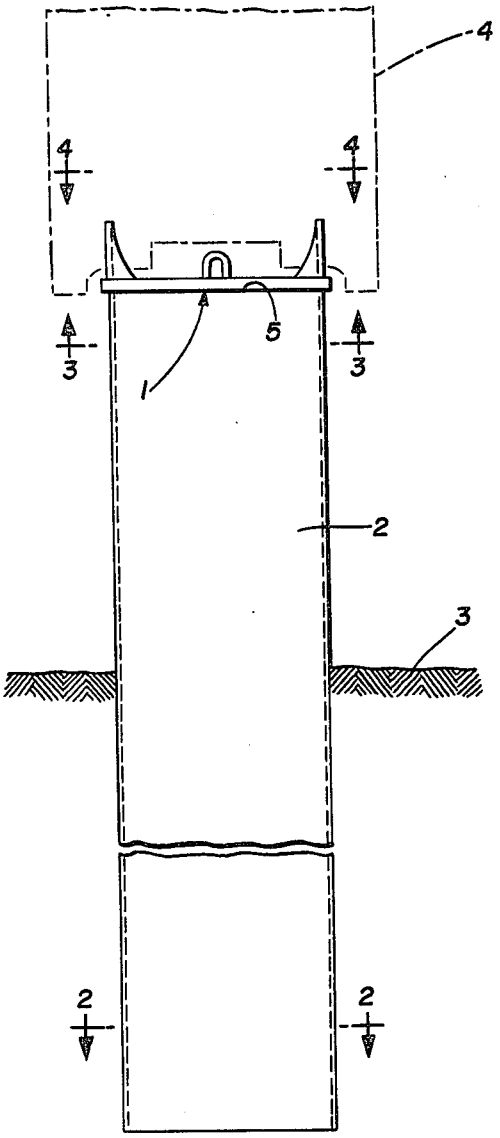
FIG. 1 is a fragmentary diagrammatic view of the improved caisson cap mounted on a caisson partially driven into the soil by a sonic or vibratory driver/extractor mechanism shown in dot-dash lines.
Figure 2:
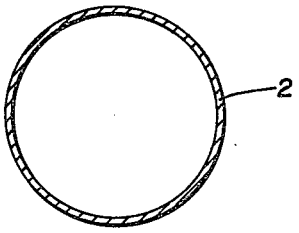
FIG. 2 is a sectional view taken on line 2—2, FIG. 1.

The improved caisson cap is indicated generally at 1, and is shown in FIG. 1 mounted on the top of a caisson 2 which is shown being partially driven in soil 3 by a sonic or vibratory driver/extractor represented by dot-dash lines 4. Caisson 2 is shown as an elongated cylindrical-shaped tubular steel member with no bottom having a circular cross-sectional configuration (FIG. 2). Caisson 2 may have other configurations, such as a corrugated or multi-faced polygon cross-sectional contour, without affecting the concept of the invention. Caisson cap 1 can be mounted on the top of these caissons having such different styles and configurations and provide the improved results and advantages without difficulty.

Figure 3:
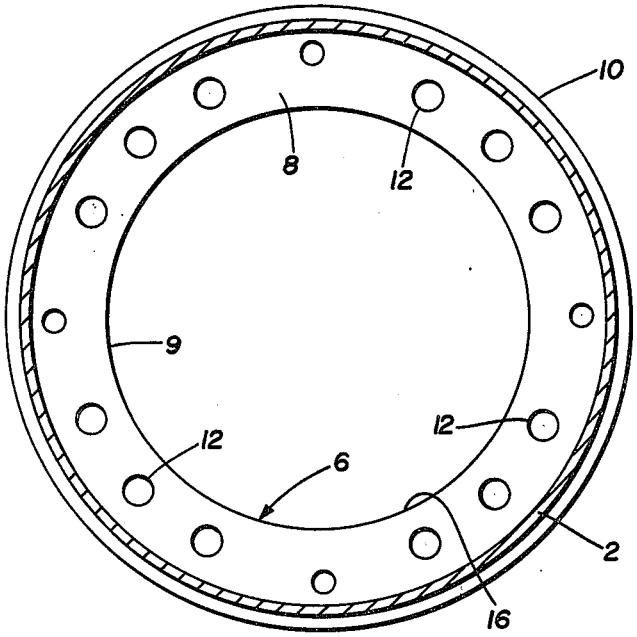
FIG. 3 is a sectional view taken on line 3—3, FIG. 1.
Figure 7:
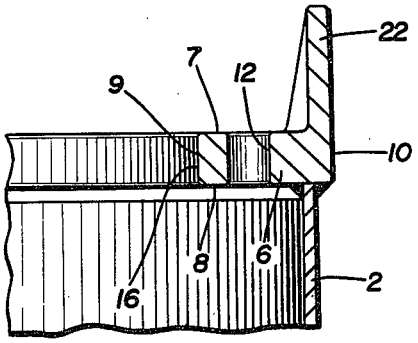
FIG. 7 is a fragmentary sectional view taken on line 7—7, FIG. 4.
Figure 9:
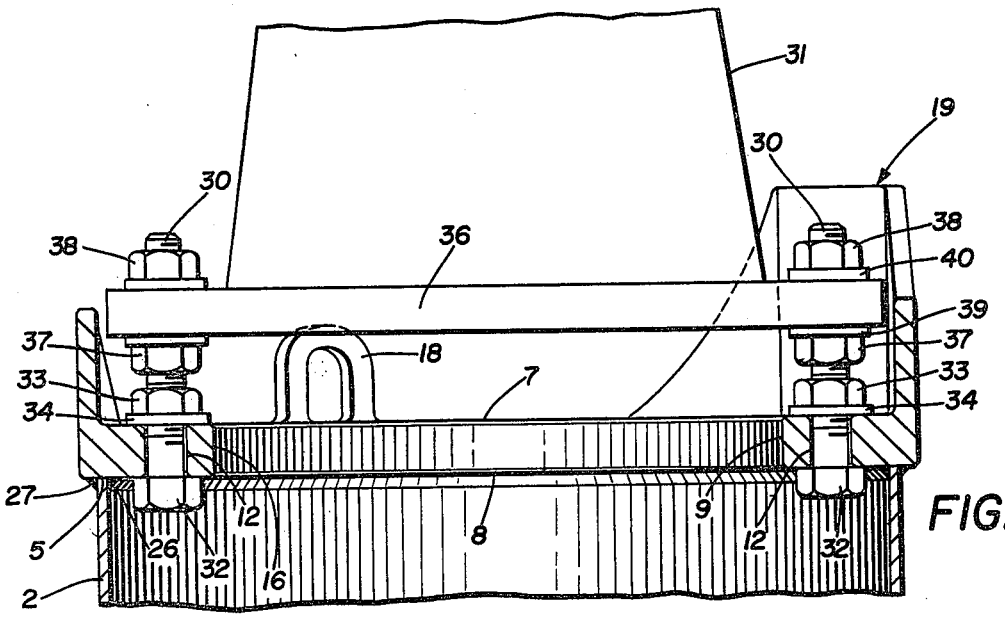
FIG. 9 is a fragmentary sectional view taken on line 9—9, FIG. 4, showing a superstructure being bolted to the top of the improved caisson cap.

Cap 1 includes an annular-shaped base, indicated generally at 6 (FIG. 4), which has an annular-shaped top surface 7 and a similarly shaped bottom surface 8 (FIG. 3) connected by concentric inner cylindrical wall 9 and outer cylindrical wall 10. A plurality of bolt-receiving holes 12 are formed in base 6 and extended between top and bottom surfaces 7 and 8 for receiving the mounting bolts of a superstructure to be supported by cap 1 and caisson 2, as shown in FIG. 9. Bolt holes 12 are arranged in a spaced pattern on base 6 and may vary in pattern and number depending upon the particular application with which cap 1 is to be used. Tweleve bolt-receiving holes 12 are shown in the particular embodiment shown in the drawings. A pair of diametrically spaced galvanizing drain holes 13 are formed in base 6 in addition to a pair of diametrically opposite water drain holes 14 spaced 90° from drain holes 13. The purpose of holes 13 and 14 is discussed in greater detail below.

In accordance with one of the main features of the invention, base 6 is formed with a central opening 16 which has a size relatively large with respect to the overall size of base 6. As shown in the drawings, the opening 16 is approximately 70% of the size of cap 1. However, this relationship may vary depending upon the particular design of cap 1 for a particular caisson and amount of strength required for the supported structure. Also, the size of opening 16 may vary in relationship to the thickness of base 6. This enlarged central opening provides a considerable number of advantages not present with known caisson caps. A pair of lifting lugs 18 are mounted diametrically opposite of each other on top surface 7 of base 6 and project upwardly therefrom. Lugs 18 preferably have an inverted U-shaped configuration and are formed integrally with base 6 during the cast forming thereof.

Figure 4:
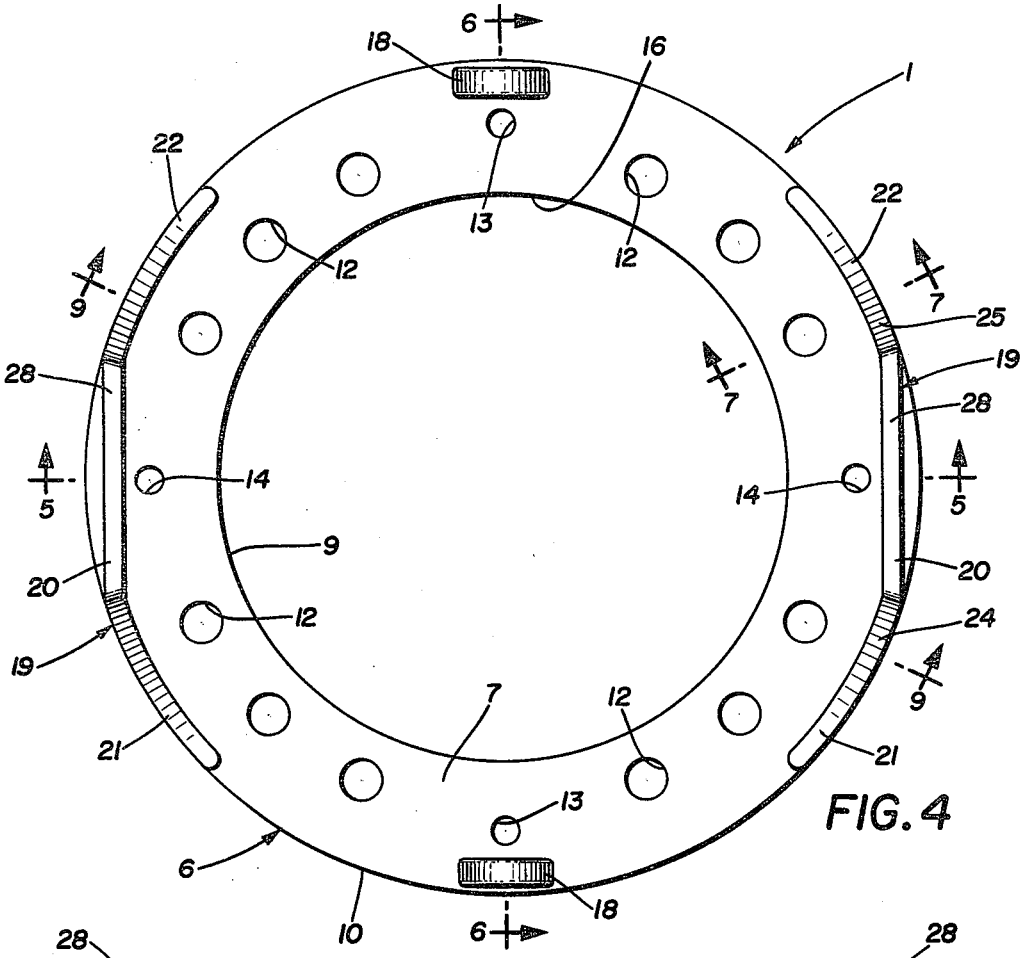
FIG. 4 is an enlarged top plan view of the caisson cap looking in the direction of arrows 4—4, FIG. 1.
Figure 5:
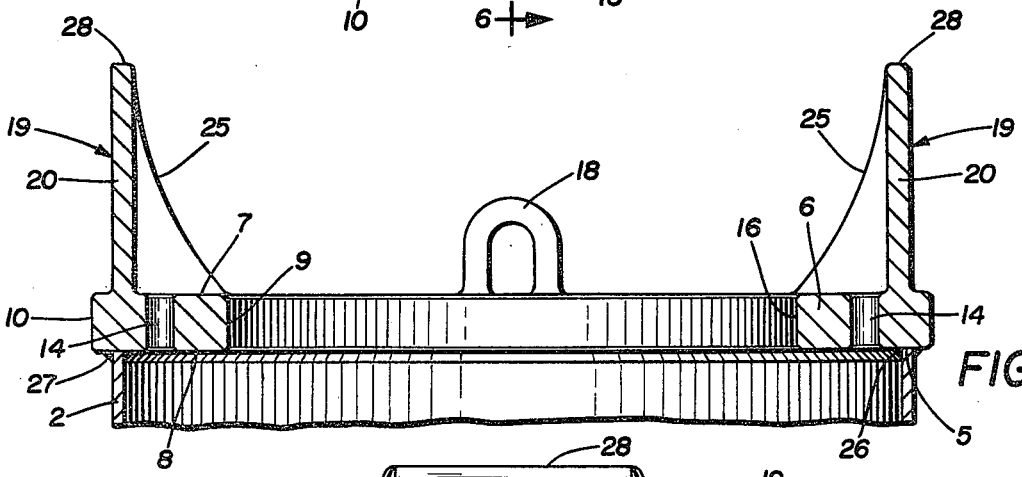
FIG. 5 is a fragmentary sectional view taken on line 5—5, FIG. 4.
Figure 6:
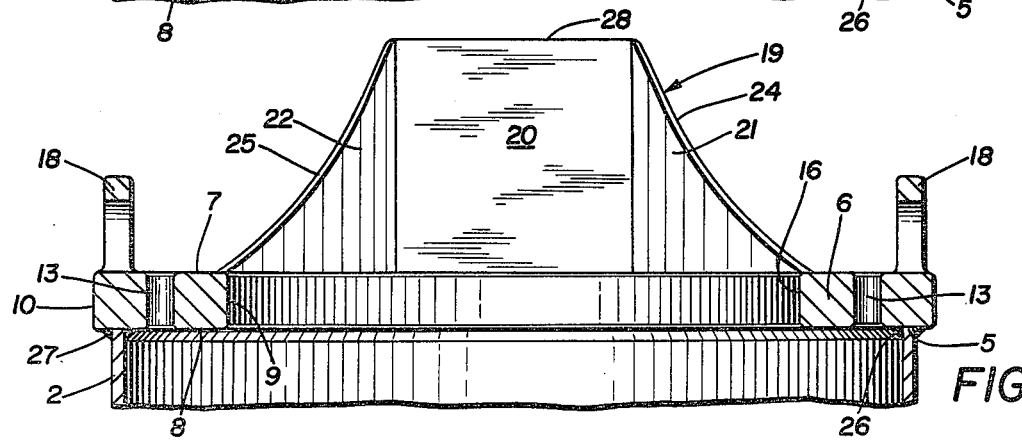
FIG. 6 is a fragmentary sectional view taken on line 6—6, FIG. 4.

In accordance with another feature of the invention, a pair of clamping plates, indicated generally at 19, are provided on top surface 7 of base 6 and are spaced 90° with respect to lifting lugs 18, as shown in FIGS. 4, 5 and 6. Clamping plates 19 are similar to each other, each having a straight central section 20 which terminates in a pair of integrally joined end sections 21 and 22. Central section 20 preferably is a rectangular-shaped flat member (large enough to accommodate the driving clamps of the sonic or vibratory/extractor equipment) and extends in a chordlike fashion across a portion of base 6 (FIG. 4). End sections 21 and 22 each has a contour preferably equal to the contour of the outer peripheral wall 10. For the configuration represented by FIG. 4, the end sections 21 and 22 extend along the periphery of the base 6 so that the total angle included by 19 is approximately 90°. Top edges 24 and 25 of curved end sections 21 and 22 preferably extend downwardly outwardly away from central section 20, as shown in FIG. 6, and top edge 28 of central section 20 preferably is parallel with top surface 7 of base 6.

In accordance with another of the main features of the invention, base 6, clamping plates 19, and lugs 18 are formed as an integral one-piece metal member that is formed of cast steel.

Cap 1 may be mounted on the open top end 5 of caisson 2 by inner and outer welds 26 and 27 (FIGS. 5 and 6) which extend between the inside wall of caisson 2 and bottom surface 8 and between the outside wall of caisson 2 and bottom surface 8 of base 6. In accordance with one of the advantages of the invention, a workman can form interior weld 26 from the exterior of cap 1 due to the relatively large size of cap opening 16. This feature saves considerable time and convenience in forming weld 26, in addition to enabling the workman to form a more satisfactory weld which can be inspected easily after completion. Other types of welds that develop the structural requirements of the connection may be employed.

After cap 1 is welded on the top of caisson 2, a secondary hoisting line from the vibratory crane can easily raise the caisson and cap to a vertical position by means of lifting lugs 18. After the sonic or vibratory driver is connected to clamping plates 19 and installation has begun, lugs 18 enable the caisson and cap to be raised upwardly to adjust for any misalignment of the caisson which can occur if sections of the caisson wall come into contact with hard rock or buried objects or to remove the caisson entirely if required. The sonic or vibratory driver can remain rigidly connected to the caisson with clamping plates 19 during such adjustment since the vibratory crane secondary hoist line can remain attached to lugs 18 to temporarily raise the caisson and cap the required distance, after which the sonic or vibratory driver can continue the installation of the unit.

After caisson 2 has been driven to the desired depth in soil 3, a plurality of bolts 30 are installed in holes 12 for mounting a superstructure 31 on the top of cap 1. Bolt heads 32 are clamped against bottom surface 8 of base 6 by nuts 33 with washers 34 being interposed between top surface 7 of base 6 and nuts 33 (FIG. 9). If desired, bolts 30 can be initially installed in openings 12 by nuts 33 prior to vibrating the caisson into the soil. Should nuts 33 become loosened during the driving operation, they can be retightened easily by a workman reaching through the enlarged central opening 16 to hold the bolt head 32 in place while the nut 33 is retightened. Bolts 30 also can be installed after the caisson has been embedded in the soil, which is considerably easier than in prior caisson cap constructions due to the enlarged size of opening 16. After bolts 30, nuts 33 and washers 34 have been installed, base plate 36 of superstructure 31 then can be secured on top of cap 1 by additional nuts 37 and 38 and washers 39 and 40.

Figure 8:
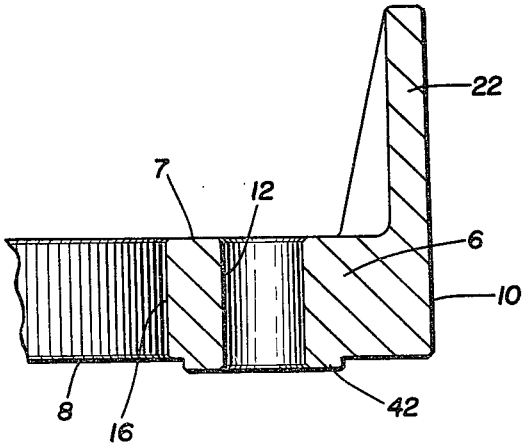
FIG. 8 is a fragmentary sectional view of a modified form of the cap showing bosses formed on the bottom surface thereof.

FIG. 8 shows a modification of cap 6 in which bosses 42 are formed integrally with base 6 during the casting thereof, and extend downwardly from bottom surface 8 axially aligned with bolt holes 12. Bosses 42 provide contact areas for bolt heads 32 and increase clearances from the bolt heads to the caisson welds to facilitate installation of the bolts.

Figure 10:
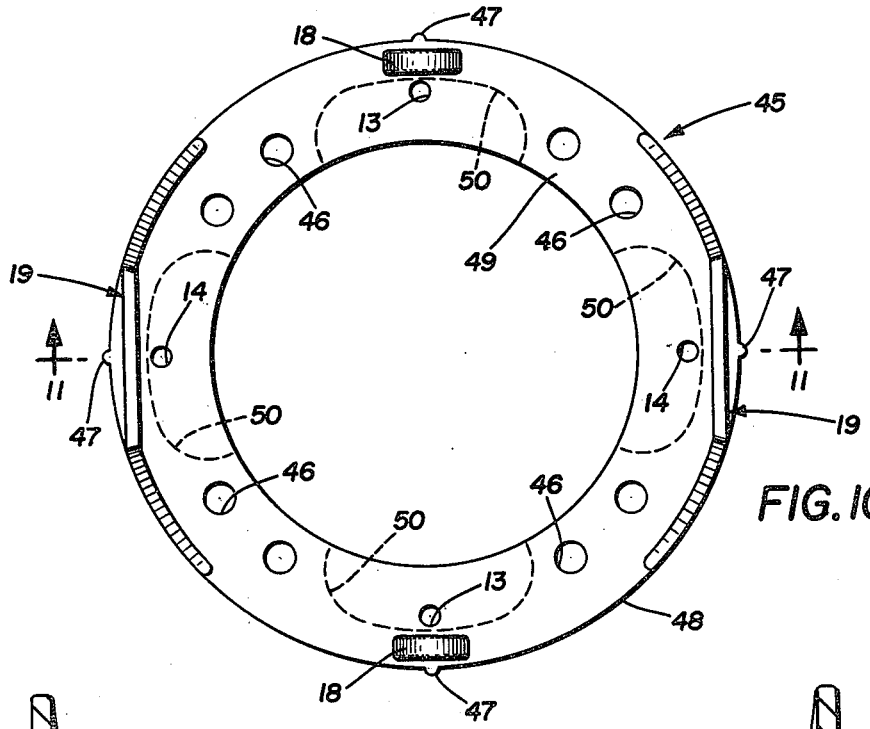
FIG. 10 is a reduced top plan view similar to FIG. 4 of a modified caisson cap.
Figure 11:
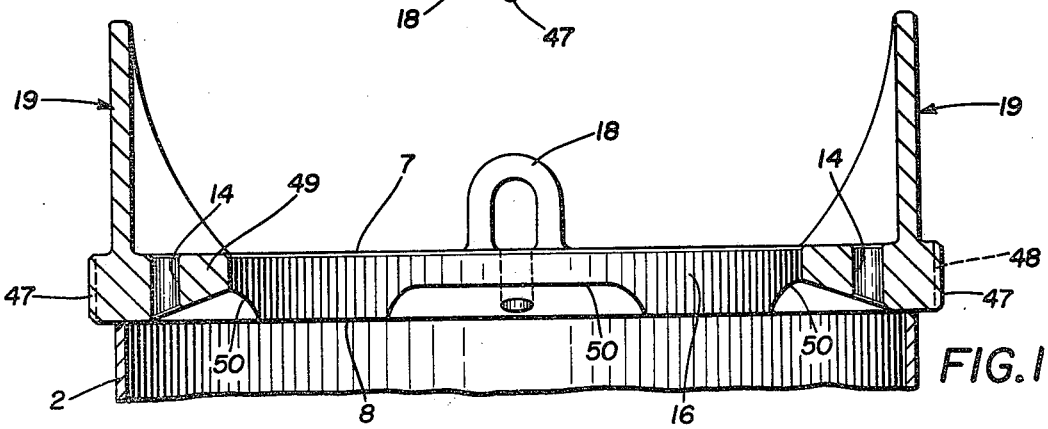
FIG. 11 is an enlarged fragmentary sectional view taken on line 11—11, FIG. 10.

A modified form of the improved caisson cap is indicated generally at 45, and is shown in FIGS. 10 and 11. Cap 45 is similar in most respects to cap 1 except that it is formed with eight bolt-receiving holes 46 instead of the twelve bolt-receiving holes 12 of cap 1. Cap 45 also is provided with center line alignment projections 47 formed on outer cylindrical wall 48 and spaced 90° from each other. Projections 47 are located adjacent lifting lugs 18 and the center of clamping plates 19. Galvanizing drain holes 13 and water drain holes 14 are formed in the base 49 of modified cap 45 adjacent lugs 18 and clamping plates 19, as in base 6 of cap 1.

One of the main differences between modified cap 45 and cap 1 is that the bottom of cap base 49 is formed with a plurality of recesses or cutouts 50. Recesses 50 have a somewhat oval configuration and are formed in the vicinity of drain holes 13 and 14. Recesses 50 merely reduce the amount of metal in base 49 without sacrificing the required strength since the base remains sufficiently thick in the areas of the base surrounding bolt-receiving holes 46. Thus by forming recesses 50 in those areas of the base where the extra metal is not required for strength, the weight as well as the cost of the cap can be reduced without sacrificing strength. The remaining features and construction of cap 45 are similar to those described above with respect to cap 1.

Representative examples of caissons with improved caisson caps 1 and 45 are as follows. Caisson 2 has a length of approximately thirty feet and is formed of tube steel meeting the criteria of ASTM standard A36. The caisson has an outside diameter of approximately forty-two inches and is hot dipped galvanized, as are caps 1 and 45. Caps 1 and 45 are formed of cast steel to ASTM specifications A148-80, GR105-85 and have an outside diameter of approximately forty-four inches. Cap 1 has a thickness of approximately three inches, and cap 45 has a thickness of three and one-half inches. In accordance with one of the main advantages of the invention, openings 16 each has a diameter of approximately thirty inches which is approximately 70% of the outer diameter of base 6. This important relationship also can be expressed by the relationship of the area of opening 16 with respect to the area circumscribed by the periphery of base 6 and base 49. For the examples given above the area of opening 16 is 46%, or approximately 50% of the area bounded by the periphery of bases 6 and 49.

Central sections 20 of clamping plates 19 have a thickness of approximately one inch and a length and height of approximately twelve inches, with the thickness of curved end sections 23 and 24 also being approximately one inch. These dimensions and specifications are for a preferred type of construction and are set forth as examples only and can vary without affecting the concept of the invention.

During the galvanizing of caissons with caps 1 or 45, the caissons are suspended above the various processing tanks in a position whereby the longitudinal axis of the caisson is inclined slightly from horizontal with the capped end at the lowest point. The caisson is held in this position by two hoist lines, one to a lifting lug 18 and the other to an attachment device at the other end of the caisson 2. The caissons are inserted in the tanks at an inclined angle with the capped end downward which enables the caissons to descend easily below the level of the processing liquids.

Galvanizing drain holes 13 permit processing liquids to flow into the descending caisson and minimize the tendency of the caisson to float before the liquid level reaches the lowest point of the central opening 16. The descending caisson continues to fill with processing liquids flowing through the central opening 16 until the high point of the central opening is reached. As the caisson descends further, the processing liquids will continue to fill the interior of the caisson since the air that normally would be trapped between the bottom surface 8 of the cap 1 or 45 and the inside wall of the caisson 2 is vented through the galvanize drain hole 13 at the upper level of the liquid. As the caisson is removed from the various galvanize processing tanks, the galvanize drain holes 13 minimize entrapment of the liquids between the bottom surface 8 of caps 1 or 45 and the inside wall of the caisson 2.

Water drain holes 14 prevent water from damming up adjacent to clamping plates 19 on top surface 7 of bases 6 and 49 after the caissons are installed in the field, which can occur if the cap plate is not perfectly horizontal. A pool of water continuously standing behind one of the clamping plates 19 could result in rust and corrosion problems. Therefore, in the event that cap 1 or 45 is installed or assumes an uneven position, drain holes 14 will prevent such an accumulation of water.

Accordingly, improved case steel caisson caps 1 and 45 provide a construction which provides high structural strength, for example 85 ksi yield, with a relatively large central opening without substantially thickening the plate. This is in contast to the prior non-cast steel plates which have a considerably smaller central opening diameter for the same thickness plate. The improved cap is lighter in weight and in size, which reduces shipping costs and facilitates handling thereof, reduces the amount of galvanizing material required for coating the same, and due to the curved configuration of the cap and components thereof results in better galvanizing coating than in prior constructions having sharp points, edges and pockets. Also elimination of sharp points, edges and pockets minimizes structurally objectionable stress raisers. The cast forming of the sonic or vibratory driver/extractor clamping plates integrally with the base ensures uniformity and accurate positioning of the clamping plates on the base at all times, eliminating misalignments that can occur when the clamping plates are individually welded to the top of each cap, as in prior constructions. The curved ends of the lifting plates also distribute the stresses placed thereon more evenly to the caisson and act as stiffeners to resist lateral loads reducing breakage.

The enlarged central opening enables an interior annular cap weld to be performed by a workman exterior of the caisson instead of interiorly, and enables the weld to be easily visible for inspection after completion. Installation of the supported superstructure bolts is facilitated due to the enlarged opening, and the workman will have clearer visibility into the interior of the caisson at all times.

Another advantage is the attachment or integral forming of a pair of lifting lugs on the top surface of the cap, which can be used during manufacturing, shipment, galvanizing and field installation of the caisson. The lugs also can be used to adjust for misalignment that can occur during driving of the caisson into the soil.

Accordingly, the construction as simplified, provides an effective, safe, inexpensive and efficient device which achieves all the enumerated objectives, provides for eliminating difficulties encountered with prior devices and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved caisson cap is constructed and used the characteristics of the construction, and the advantageous, new and useful results obtained, the new and useful structures, devices, elements, arrangements, parts and combinations are set forth in the appended claims.

I claim:

1. A cap construction for mounting on the top of an elongated generally tubular foundation caisson, said construction including:

(a) a cast steel base formed with a central opening, said central opening having an area approximately 50% of the area defined by the periphery of the base;

(b) a plurality of spaced bolt-receiving holes formed in the base; and (c) clamping plate means mounted on the base for cooperative engagement with a mechanism for driving the caisson into the soil, with said plate means being located radially outwardly of the bolt-receiving holes and extending upwardly from the base.

2. The cap construction defined in claim 1 in which the base has an annular configuration; in which the clamping plate means includes a pair of diametrically spaced clamping plates formed integrally with the base; and in which each of the clamping plates includes a central section which extends in a chordlike fashion with respect to the periphery of the base and a pair of end sections which have contours approximately equal to the contour of the annular base.

3. The cap construction defined in claim 2 in which the central section of each clamping plate is a generally flat rectangular-shaped member; and in which the end sections of each plate have upper curved edges which curve downwardly and away from the central section toward the base.

4. The cap construction defined in claim 2 in which each of the end sections of the clamping plates has a length such that the total angle encompassed by the central section and the adjacent end sections is approximately 90°.

5. The cap construction defined in claim 1 in which a pair of lugs is mounted on the base to provide attachment points for lifting the cap.

6. The cap construction defined in claim 5 in which the lugs are located diametrically opposite of each other on the base and project outwardly therefrom.

7. The cap construction defined in claim 5 in which the lugs are formed integrally with the base of cast steel.

8. The cap construction defined in claim 5 in which a drain hole is formed in the base adjacent each of the lugs.

9. The cap construction defined in claim 1 in which the base has an annular configuration and the central opening is circular in cross section; and in which the diameter of the central opening is approximately 70% of the base diameter.

10. The cap construction defined in claim 1 in which a plurality of alignment projections are formed integrally with the base at spaced locations about the periphery of said base.

11. The cap construction defined in claim 1 in which drain hole means is formed in the base adjacent the clamping plate means for preventing water from collecting adjacent said clamping plate means.

12. A caisson construction including:

(a) an elongated generally tubular metal member having open top and bottom ends;

(b) a cast steel integral one-piece cap mounted on the top end of the tubular member; said cap including:

(i) a base formed with a central opening;

(ii) a plurality of spaced bolt-receiving holes formed in the base;

(iii) clamping plate means formed integrally with the base and located radially outwardly from the bolt-receiving hole and projecting upwardly from the base for operative engagement with a mechanism for installing the caisson in the soil; and (iv) lug means formed integrally with the base for engagement by a lifting mechanism.

13. The caisson construction defined in claim 12 in which the base has an annular configuration with a diameter larger than the diameter of the top end of the tubular member.

14. The caisson construction defined in claim 13 in which weld means is formed between the base and top end of the tubular member for mounting the base on the top end of the tubular member.

15. The caisson construction defined in claim 12 in which the base clamping plate means is a pair of diametrically spaced clamping plates; in which the lug means is a pair of diametrically spaced lugs spaced 90° from the clamping plates.

16. The caisson construction defined in claim 15 in which the clamping plates are similar to each other, and each has a straight center section and a pair of end sections.

17. The caisson construction defined in claim 12 in which the base has generally flat top and bottom surfaces; and in which the clamping plate means extends upwardly from the top surface and is located closely adjacent the periphery of the base.

18. The caisson construction defined in claim 17 in which a plurality of recesses are formed in the bottom surface of the base.

19. The caisson construction defined in claim 12 in which a plurality of alignment projections are formed integrally with the base and are spaced about the periphery of said base.

20. The caisson construction defined in claim 12 in which the central opening has an area at least 50% of the area defined by the periphery of the base.

* * * * *